US010569158B2

(12) United States Patent
Kaiser

(10) Patent No.: US 10,569,158 B2
(45) Date of Patent: Feb. 25, 2020

(54) BOWLING PIN SETTER MECHANISM

(71) Applicant: Philip Kaiser, Spencerport, NY (US)

(72) Inventor: Philip Kaiser, Spencerport, NY (US)

( * ) Notice: Subject to any disclaimer, the term of this patent is extended or adjusted under 35 U.S.C. 154(b) by 0 days.

(21) Appl. No.: 16/019,487

(22) Filed: Jun. 26, 2018

(65) Prior Publication Data

US 2019/0388772 A1 Dec. 26, 2019

(51) Int. Cl.
*A63D 5/08* (2006.01)

(52) U.S. Cl.
CPC ..... *A63D 5/08* (2013.01)

(58) Field of Classification Search
CPC ..... A63D 5/08; A63D 5/09
USPC ..... 473/73, 83, 84, 89, 95
See application file for complete search history.

(56) References Cited

U.S. PATENT DOCUMENTS 857,939 A * 6/1907 Heath ..... A63D 5/08 473/84
2,688,487 A * 9/1954 Montooth ..... A63D 5/08 473/64
2,723,123 A * 11/1955 Hedenskoog ..... A63D 5/08 473/92
2,887,318 A 5/1959 Whipple et al.
3,072,404 A * 1/1963 Jennings ..... A63D 5/08 473/84
3,094,325 A * 6/1963 Torresen ..... A63D 5/04 473/69
3,232,611 A * 2/1966 Fossberg ..... A63D 5/08 473/94
3,278,186 A * 10/1966 Torresen ..... A63D 5/04 473/69
6,319,144 B1 * 11/2001 Hasty ..... A63D 3/00 273/118 R
6,358,155 B1 3/2002 Huhne

* cited by examiner

*Primary Examiner* — William M Pierce
(74) *Attorney, Agent, or Firm* — Tracy Jong Law Firm; Tracy P. Jong; Cheng Ning Jong

(57) ABSTRACT

A bowling pin setter mechanism comprising a vertically-arranged lift assembly and a combined spot and re-spotting assembly. The latter includes a top member including a chute, the top member configured to move in a top plane; a bottom member including a bottom opening having an area of a first size and a support plate disposed adjacent the bottom opening, the bottom member disposed in a bottom plane; a middle member including a middle opening and a channel extending from the middle opening at a neck area, the middle member disposed between the top member and the bottom member, the middle member configured to move in a middle plane parallel to the top plane and the bottom plane; and an actuator configured for lowering and raising an aggregate group of said top, middle and bottom members.

3 Claims, 19 Drawing Sheets

FIG. 6
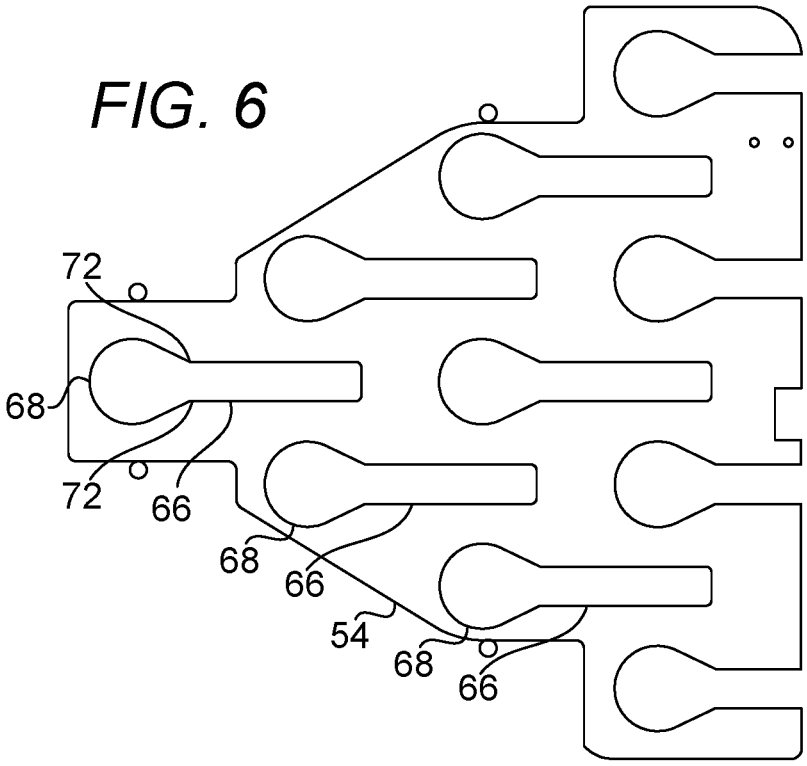
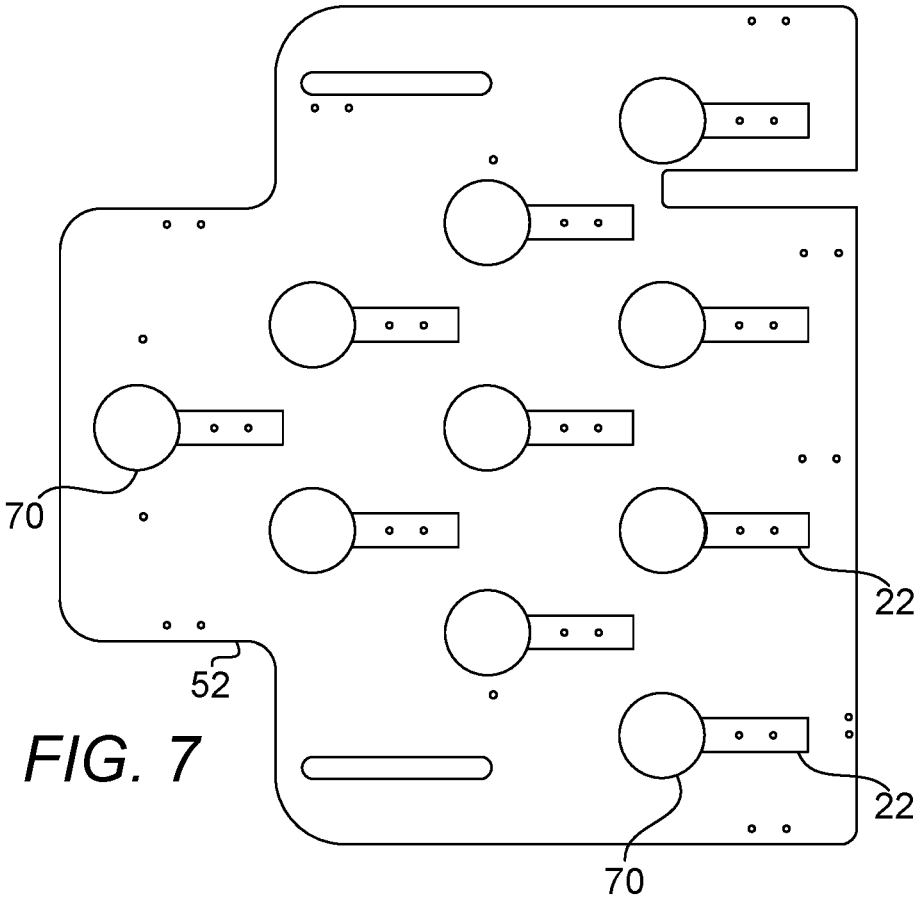
FIG. 7

BOWLING PIN SETTER MECHANISM

BACKGROUND OF THE INVENTION

1. The Field of the Invention

The present invention relates to a mechanism for setting bowling pins. More specifically, the present invention is directed to pin lift, spot and re-spot actions in handling bowling pins.

2. Background Art

A bowling pin setter mechanism which takes pins from a previously played game, lifts them off a collecting area before resetting the pins is known from U.S. Pat. No. 2,887,318. This machine includes a clearing device, a vertical conveyor, a pin divider, as well as a pin holding and setting unit. The mechanics of the prior setting machine are technically complex to use. The failure of only one unit within the prior pin setting machine can cause the entire system of the bowling alley to break down which, because of the complexity of the machinery, can only be repaired by costly and extensive maintenance by experts. Further, these systems are expensive for the facility to install and maintain. A further disadvantage is that it is not possible for the setting machine disclosed in the '318 patent to create varied selective pin settings on the alley.

U.S. Pat. No. 6,358,155 discloses an automatic bowling pin setting machine including a sorting section receiving knocked down pins and bowling balls, an elevator conveying pins to a receiving reel, and a setting reel to which pins drop downwardly from the setting reel. Gripper arms accompanying the setting reel pick up any standing pins to ready the alley for a second throw. After a second throw, the alley is swept clean of pins, and the setting reel places a new set of pins in the alley. Although the '155 setting machine is alleged to have been designed with reduced maintenance in mind and for sureness of operation, there are still numerous parts that are involved in lifting, spotting and re-spotting of pins, making this machine both costly to procure and maintain.

There arises a need for a bowling pin setter mechanism that is economical to manufacture and cost effective to maintain.

SUMMARY OF THE INVENTION

In accordance with the present invention, there is provided a bowling pin setter mechanism including a lift assembly including:

(a) a continuous band configured to revolve between a top portion and a bottom portion of the continuous band in a first direction;

(b) a shelf includes a width, two slits and two widthwise edges, the shelf is attached to the continuous band with the width of the shelf disposed substantially at right angle to the first direction, wherein the shelf is configured to receive a bowling pin having a skirt and a belly and move the bowling pin from the bottom portion to the top portion of the band; and (c) two fangs disposed at the top portion of the continuous band within a sweep area of the shelf, each of the two fangs is disposed at a first distance with one of the two widthwise edges of the shelf, wherein each of the slits is configured to allow one of the two fangs to start making contact and continue making contact as the continuous band continues to revolve to push the bowling pin away from the continuous band to exit at the top portion of the continuous band.

In one embodiment, the shelf further includes a depth and a depthwise edge, wherein the two fangs extend at a substantially similar depth from the depthwise edge of the shelf and such that the two fangs first make contact with the bowling pin disposed on the shelf at only one of the two fangs at the belly of the bowling pin, causing the bowling pin to leave the shelf in an orientation with the skirt of the bowling pin facing away from the shelf.

In one embodiment, a ratio of the first distance to the width of the shelf is about 0.24 such that one of the two fangs contacts the belly of the bowling pin to eject the bowling pin from the shelf in an orientation with the skirt of the bowling pin facing away from the shelf.

In one embodiment, the continuous band includes a pair of chains configured to rotate in unison.

In one embodiment, the continuous band includes a chain including a plurality of links, each link including two ends, each end of each of the plurality of links configured to be connected to one end of another link of the plurality of links.

In one embodiment, the continuous band includes a belt.

In one embodiment, the vertically-arranged lift assembly is adapted for use with regulation bowling and miniature bowling.

In one embodiment, the bowling pin setter mechanism further includes a pin collecting mechanism including:

(a) a top member including a top opening having an area of a first size, the top member having a first axis of rotation; and (b) a bottom member including a bottom opening having an area of a second size that is at least as large as the first size, the bottom member having a second axis of rotation coaxially disposed with the first axis of rotation, wherein the top member and the bottom member are rotationally disposed about the first axis of rotation such that the top opening is offset from the bottom opening by an angle to form a support surface on the bottom member that supports the bowling pin before the bowling pin is released by lessening the offset.

In one embodiment, the offset is about 16 degrees.

In one embodiment, the bowling pin setter mechanism further includes a break beam sensor configured to distinguish a legitimate object from an illegitimate object at an access point of the bowling pin setter mechanism such that the bowling pin setter mechanism can be shut down to prevent injury to the illegitimate object incurred by the bowling pin setter mechanism.

In accordance with the present invention, there is provided a bowling pin setter mechanism for setting a bowling pin having a maximum longitudinal cross-sectional area, wherein the bowling pin setter mechanism including:

a combined spot and re-spotting assembly including:

(a) a top member including a chute, the top member configured to move in a top plane;

(b) a bottom member including a bottom opening having an area of a first size and a support plate disposed adjacent the bottom opening and the bottom member disposed in a bottom plane;

(c) a middle member including a middle opening and a channel extending from the middle opening at a neck area, the middle member disposed between the top member and the bottom member, the middle member configured to move in a middle plane parallel to the top plane and the bottom plane; and (d) an actuator configured for lowering and raising an aggregate group of the top, middle and bottom members, wherein the bottom member and the middle member are configured to be slidably coupled such that the channel slides relative to the support plate disposed within the channel, the support plate protruding beyond a top surface of the middle member for supporting the bowling pin while the bowling pin is disposed within the chute, the top member is adapted to be positioned such that if the chute is aligned with the middle opening biased in position with respect to the bottom opening to form a composite opening of an area of a second size that is smaller than the maximum longitudinal cross-sectional area of the bowling pin, the bowling pin drops into and is retained in the composite opening before the aggregate group is lowered by the actuator such that the bowling pin can be spotted onto a pin deck after the middle member is adjusted such that the composite opening becomes greater than the maximum longitudinal cross-sectional area of the bowling pin and if the composite opening is aligned with the bowling pin, the middle opening is biased with respect to the bottom opening, the bowling pin is raised at the neck area when the aggregate group is raised to allow sweeping to occur at the pin deck and the aggregate group is lowered onto the pin deck, the bowling pin is re-spotted.

In one embodiment, the top member further includes a top opening that accommodates the bowling pin that is being re-spotted so that the top member can be disposed at a minimum distance from the middle member to form the aggregate group that is compact.

In one embodiment, the ratio of the second size to the first size is about 0.8.

In one embodiment, the bowling pin setter mechanism further includes a break beam sensor configured to distinguish a legitimate object from an illegitimate object at an access point of the bowling pin setter mechanism such that the bowling pin setter mechanism can be shut down to prevent injury to the illegitimate object incurred by the bowling pin setter mechanism.

In one embodiment, the combined spot and re-spotting assembly is adapted for use with miniature bowling.

In accordance with the present invention, there is provided a method for shutting down a bowling pin setter mechanism using a sensor disposed at an entrance to the bowling pin setter mechanism and a relay which selectively provides power to the bowling pin setter mechanism, the sensor and the relay functionally connected to a controller, the method including:

(a) using the controller for determining the duration of activation of the sensor; and (b) using the controller for comparing the duration of activation of the sensor to a threshold, wherein if the duration of activation of the sensor exceeds the threshold, the relay is deactivated to shut down the bowling pin setter mechanism. In one embodiment, the sensor is a break beam sensor.

An object of the present invention is to provide a bowling pin setter mechanism that has few parts, thereby requiring a lower amount of maintenance and less likely to break down.

Another object of the present invention is to provide a pin lift assembly which does not require many moving parts and/or powered parts, therefore lessening the opportunities for the assembly to malfunction or for parts to break down.

Another object of the present invention is to provide a pin collecting assembly which does not require many moving parts and/or powered parts, therefore lessening the opportunities for the assembly to malfunction or for parts to break down.

Another object of the present invention is to provide a spot and re-spotting assembly which does not require many moving parts and/or powered parts, therefore lessening the opportunities for the assembly to malfunction or for parts to break down.

Another object of the present invention is to provide a bowling pin setter mechanism which is suitable for a miniature bowling environment characterized by lower procurement and maintenance costs, while mimicking closely the functionality of a regulation bowling pin setter mechanism.

Another object of the present invention is to provide a bowling pin setter mechanism which does not require the use of string-attached bowling pins in miniature bowling which alters the look-and-feel of regulation bowling which many are used to.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 6 is a top view of the middle member shown in FIG. 4.

FIG. 7 is a top view of the bottom member shown in FIG. 4.

PARTS LIST

Figure 1:
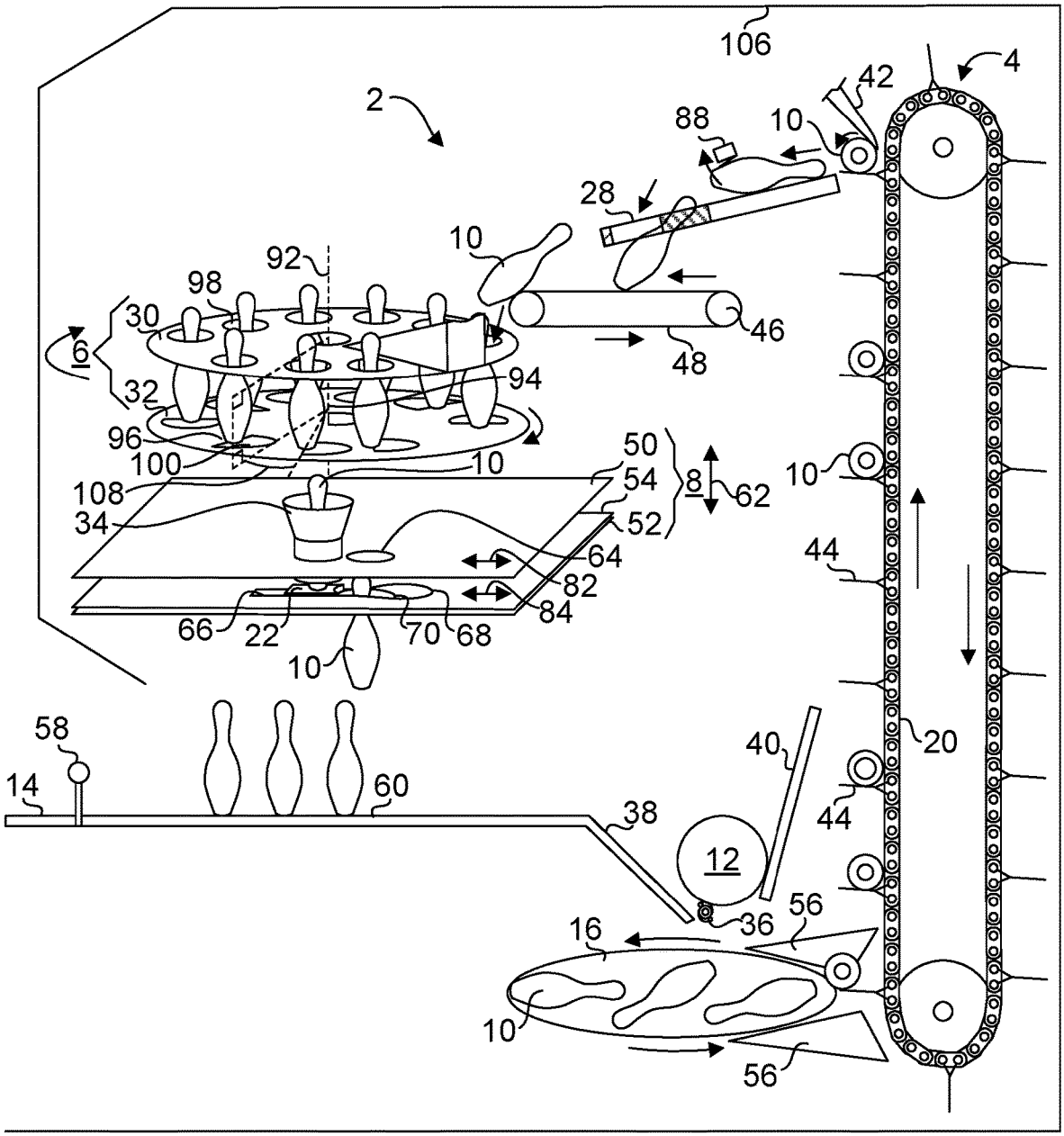
FIG. 1 is a simplified diagram depicting a pin lift assembly, pin collecting assembly and combined spot and re-spotting assembly of a bowling pin setter mechanism.

2—bowling pin setter mechanism
4—pin lift assembly
6—pin collecting assembly
8—spot and re-spotting assembly
10—bowling pin
12—bowling ball
14—bowling lane
16—sorter disk
18—sorter disk lower guide
20—band, e.g., chain, belt
22—pin support plate
24—slit
26—maximum longitudinal cross-sectional area of bowling pin
28—opening or pin orientator
30—upper disk
32—lower disk
34—chute
36—auger
38—pit board
40—pit cushion
42—pin ejector or fang
44—pin lifter, e.g., shelf, plate
46—transfer conveyor
48—belt
50—top member or chute deck
52—bottom member or main deck
54—middle member or re-spot deck
56—angled plate
58—break beam sensor
60—pin deck
62—motion
64—chute deck opening
66—channel
68—re-spot deck opening
70—main deck opening
72—transition between re-spot deck opening and channel, or neck area
74—distance between widthwise edge of shelf and slit closest to it
76—width of shelf
78—belly of bowling pin
80—skirt of bowling pin
82—motion
84—motion
86—controller
88—bowling pin sensor, e.g., a mechanical switch
90—lip
92—axis of rotation
94—axis of rotation
96—support surface
98—opening
100—opening
102—portion of pin coming in contact with middle member, e.g., at neck of pin
104—composite opening
106—enclosure
108—offset angle

PARTICULAR ADVANTAGES OF THE INVENTION

The present bowling pin setter mechanism includes significantly lower number of parts than conventional, full-sized and regulation bowling pin setting machines capable of regulation bowling or capable of meeting bowling rules or directives made and maintained by a bowling authority. Compared to conventional miniature or half-scale bowling mechanisms, the present bowling pin setter mechanism has substantially the look-and-feel of regulation bowling capable of offering substantially similar experience to regulation bowling. Contrast a bowling string machine disclosed in EP3107631 to Solmaz to the present mechanism which does not rely on strings for spotting and re-spotting. With the present mechanism, spotting and re-spotting are carried out without relying on strings, thereby removing any possibilities that strings can affect the manner in which bowling pins fall, the manner in which fallen bowling pins are removed from a pin deck and neighboring bowling pins, etc.

The present bowling pin setter mechanism includes a unified spot and re-spot assembly compared to conventional re-spot and spot mechanisms, thereby simplifying the design and maintenance of the re-spot and spot assemblies. The present spot and re-spot assembly essentially includes a plurality of plates that are disposed substantially in parallel and can be selectively actuated such that the plates move relatively in planes parallel to one another and that the assembly can be moved up and down while the distances between the plurality of plates are maintained. No individual solenoids, motors or other actuators are required to actuate parts that are related to spotting and re-spotting individual bowling pins.

The present bowling pin setter mechanism includes a pin lift assembly that does not require a plurality of actuators. Instead it includes a vertically-arranged driven chain that has pin lifters or plates disposed along the travel direction of the chain where the plates are capable of receiving bowling pins and transporting them from a first elevation to a second elevation before the bowling pins get removed from the plates by one of a pair of passive pin ejectors or fangs advantageously disposed at a location along the path of travel of the plates. No active ejectors are required. Further, upon getting removed from a plate by a fang, a bowling pin assumes a specific orientation, thereby removing the need for yet another device to rotate the bowling pin to an expected orientation so that it can be processed downstream from the pin lift assembly by another assembly for spotting and re-spotting.

The present bowling pin setter mechanism includes a collecting assembly that does not require many actuators but rather an actuator that causes a rotational indexing motion on a combined assembly of an upper disk and a lower disk. The collecting assembly caches bowling pins that have been transported by the lift assembly and ensures that a set of pins that are disposed in the correct orientation have been collected before they get released to the assembly downstream of the collecting assembly, i.e., the spot and re-spotting assembly. The release of the pins collected in assembly is effected using a motion that causes a rotational motion on the lower disk. Although bowling pins are disposed in a triangular pattern on a pin deck, Applicant discovered that a collecting assembly may be disposed in a circular fashion as the pins can be transported subsequently to a spot and re-spot assembly having receptacles disposed in a triangular fashion as the flare disposed in the mouth of each chute enables a bowling pin to be transferred from a circular arrangement of pins in the collecting assembly to a triangular arrangement of pins in the spot and re-spot assembly.

The present bowling pin setter mechanism is shut down if a foreign object is deemed to be entering the bowling pin setter mechanism through the pin deck area to prevent potential injuries to the foreign object and/or damage caused by the presence of the foreign object in the bowling pin setter mechanism. Using a break beam sensor, an object entering via the pin deck area can be inferred as a foreign object, e.g., a child or pet, entering the bowling pin setter mechanism illegitimately.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Regulation bowling is defined herein as bowling practices, equipment specifications and games, etc. which conform at least to United States Bowling Congress (USBC) rules and rules of bowling of other authorities and similar international bodies.

In each round of play in bowling, a bowler is given two throws down a bowling lane. Spotting is defined herein as the disposition of bowling pins on a bowling pin deck for the first throw of a bowling ball in each round of play in bowling while re-spotting is defined herein as the disposition of bowling pins on a bowling pin deck for the second throw of a bowling ball in each round of play in bowling. Upon spotting, there are ten bowling pins disposed in the upright position on the pin deck. After the first throw, a "strike" causes a second throw to not be necessary. If there is at least one pin left standing after the first throw, the pin is picked up and the pin deck swept to ensure no fallen pins are left on the pin deck before the pin is re-spotted on the pin deck prior to the second throw.

Figure 1A:
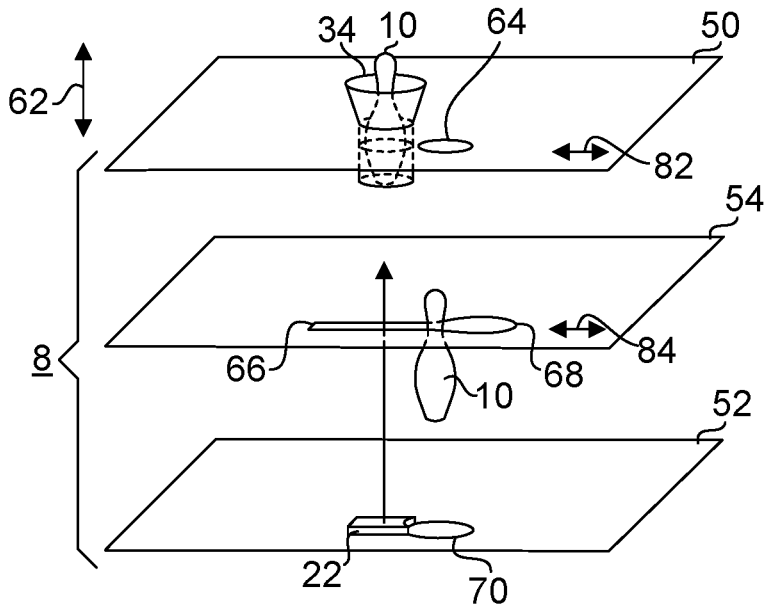
FIG. 1A is a simplified exploded view of the combined spot and re-spotting assembly of the bowling pin setter mechanism of FIG. 1.

FIG. 1 is a simplified diagram depicting a pin lift assembly, pin collecting assembly and combined spot and re-spotting assembly of a bowling pin setter mechanism 2. FIG. 1A is a simplified exploded view of the combined spot and re-spotting assembly of the bowling pin setter mechanism of FIG. 1. Only parts, components or devices that are thought to be essential to the comprehension of the functioning of the present mechanism are shown. For instance, some assemblies are shown in side orthogonal views while others are shown in perspective views when it is important to disclose the assembly in three dimensional space as they are inconsistent in the third dimensional. In use, a ball 12 is thrown and causes bowling pins 10 to be knocked onto angled pit board 38. The ball strikes pit cushion 40 and falls onto auger 36. The pins 10 fall onto pit board 38 and as the pit board is angled, slide down and drop onto sorter disk 16 or angle plates 56 which then direct the pins 10 to the spinning sorter disk 16. As the auger 36 rotates, its raised sections which spiral around a central shaft aid in driving the ball 12 to pass through a ball door (not shown) before being returned to a bowler. The auger 36 is driven by a pit motor (not shown) through a series of pulleys, belts and gear boxes (not shown). The ball 12 is prevented from falling through the opening between the auger 36 and cushion 40 due to the spacing between the two, which is only large enough to allow bowling pins 10 to pass through. As a result, the ball 12 is held above the sorter disk 16 and lands between the cushion 40 and the auger 36 while being driven to be returned to the bowler. This spinning motion of the sorter disk 16 causes the bowling pins 10 to be pushed away from the center of the sorter disk 16 and be guided by the sorter disk lower guide 18 which is positioned slightly above the sorter disk 16 and forced into the base of the pin lift assembly 4. At any moment, a pin 10 may fall onto a shelf 44 that arrives at the base of the pin lift assembly 4 and be lifted by the shelf 44 until it reaches a pin ejectors or fangs 42 disposed at a top portion of the pin lift assembly 4. Upon contacting the pin ejectors 42, the pin is moved forwardly into a pin orientator 28. The passive or non-powered pin orientator 28 receives the pin 10 upon its ejection from a shelf 44 onto a transfer conveyor 46 belt 48 bottom first or with its skirt 80 first. The pin ejectors or fangs 42 are positioned so that each causes a pin to be pushed off of a shelf 44 and enter the pin orientator 28 bottom first. The pin orientator 28 includes walls which guide the pin 10 to a center opening. This center opening is configured in the shape of a pin in the orientation desired to allow the pin 10 to pass through and be placed on the transfer conveyor 46 belt 48. The transfer conveyor 46 belt 48 then moves the pin forward into the rest of the pin setter mechanism for processing.

Upon arriving at a pin collecting assembly 6, a pin 10 is directed to a holding place in the pin collecting assembly 6 before transferring it further to a combine spot and re-spotting assembly once the pin collecting assembly 6 has been filled. The pin collecting assembly 6 is essentially constructed from two disks, i.e., a top member, e.g., an upper disk 30 and a bottom member, e.g., a lower disk 32. The top member 30 includes a number of openings 98 that is equal to the number of bowling pins 10 for each play, e.g., ten. Each top opening 98 is configured at a size that is sufficiently large to accommodate a bowling pin right side up and the top member includes a first axis of rotation 92. The bottom member 32 includes the same number of openings 100 as those of the top member 30. Each bottom opening 100 includes an area of a second size that is at least as large as the first size and a bottom member having a second axis of rotation 94 coaxially disposed with the first axis of rotation 92. The top member 30 and the bottom member 32 are rotationally disposed such that each top opening is angularly offset from a matching bottom opening by an angle 108 to form a support surface 96 on the bottom member that supports the bowling pin 10 before the bowling pin is released by lessening the offset. The pin collecting assembly 6 need not be disks but rather structures having features, e.g., cages or rings, etc., disposed in place of the upper disk and/or lower disk to hold bowling pins 10 and partial cages or rings (cages or rings each having at least a portion that is connected to an opening). In use, the pin collecting assembly 6 is indexed so that an opening on the upper disk 30 allows a bowling pin 10 to enter the opening 98 before a matching partial opening 100 on the lower disk 32 supports the bowling pin 10 preventing the downward movement of the bowling pin 10 through the lower disk 32. Upon getting all the openings 98 filled, the lower disk 32 is indexed to an angular orientation with respect to the upper disk 30 where the openings 100 of the lower disk now align with the openings 98 of the upper disk 30 to cause the bowling pins to fall through the openings 100 in the lower disk 32 and continue into the chutes 34 on the top member 50 of the spot and re-spotting assembly. Note in FIG. 1 that, for the sake of simplicity and clarity, only one set of parts is shown in the spot and re-spot assembly 8, where each set is sufficient to service one bowling pin.

In one embodiment, the bowling pin setter mechanism further includes a sensor 58, e.g., break beam sensor, etc., configured to distinguish a legitimate object from an illegitimate object at an access point of the bowling pin setter mechanism such that the bowling pin setter mechanism can be shut down to prevent injury to the illegitimate object that can be incurred by the bowling pin setter mechanism by detecting the duration of the presence of an object entering the area where the pin setter mechanism is located from the bowling lane 14. Another type of sensor is possible as long as the sensor is capable of detecting the duration of presence of an object in an entrance to the pin setter mechanism disposed within an enclosure 106. In one embodiment, an imaging sensor may be used in conjunction with machine learning as used in the field of artificial intelligence to distinguish a legitimate object from an illegitimate object. In use, upon detecting an "illegitimate" object, the bowling pin setter mechanism will be shut down until a reset button has been pressed to indicate to the controller 86 that the mechanism is again allowed to function normally. Therefore, a method is provided for shutting down a bowling pin setter mechanism using a break beam sensor disposed at an entrance to the bowling pin setter mechanism, e.g., via the bowling lane 14, and a relay which selectively provides power to the bowling pin setter mechanism and functionally connected to the controller 86. The method includes (a) using the controller 86 for determining the duration of activation of the break beam sensor 58; and (b) using the controller for comparing the duration of activation of the break beam 58 sensor to a threshold, wherein if the duration of activation of the break beam sensor exceeds the threshold, the relay is deactivated to shut down the bowling pin setter mechanism. For instance, a bowling ball 12 that moves towards the entrance to the bowling pin setter mechanism on the pin deck 60 may only cause the break beam sensor to active for 0.3 second as it passes the break beam sensor. However an illegitimate object, e.g., a human or a pet animal may cause the break beam for a duration that is significantly longer than the duration it takes a bowling ball to activate the break beam sensor, e.g., 1.5 to 2 seconds. In one embodiment, a threshold that works well is about 0.2 second. Therefore, the present safety system allows any legitimate bowling activity to occur while being capable of shutting down the bowling pin setter mechanism should an illegitimate object is deemed entering the pin setter mechanism.

Figure 2:
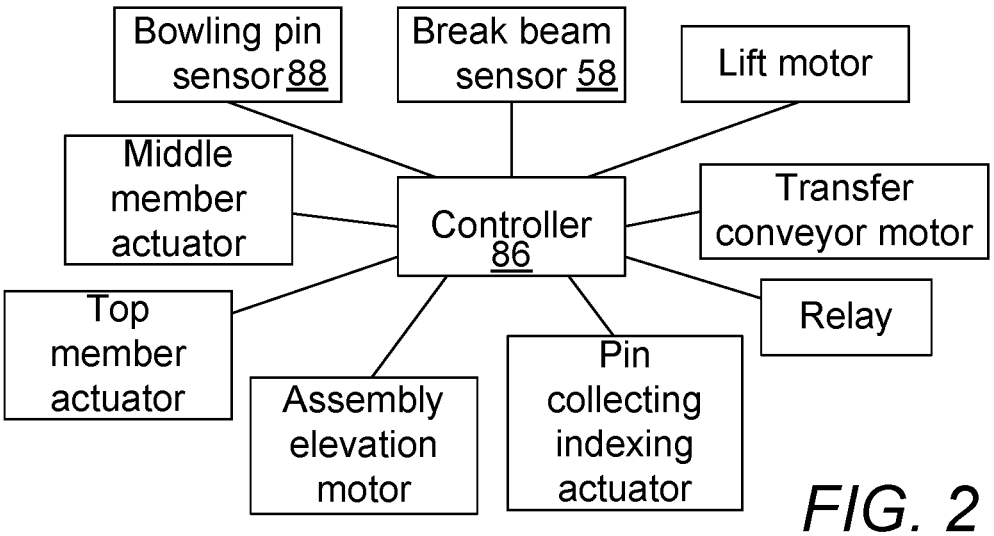
FIG. 2 is a diagram depicting actuators and sensors useful for controlling a bowling pin setter mechanism.

FIG. 2 is a diagram depicting actuators and sensors useful for controlling a bowling pin setter mechanism. At the heart of the present pin setter mechanism is a controller 86 to which various sensors and actuators are functionally connected. For instance, a break beam sensor 58 is functionally connected to the controller 86 where the sensor is configured for detecting an illegitimate object that can subsequently cause the controller 86 to deactivate a relay which cuts power to all actuators which drives various assemblies of the present pin setter mechanism. A lift motor is suitable for driving the band 20 in lifting bowling pins from the sorter disk 16 to the pin collecting assembly 6. A bowling pin sensor, e.g., mechanical switch 88 is suitable in indicating to the pin collecting assembly 6 that a pin is anticipated at the assembly 6 and that a receptacle of at pin collecting assembly 6 must be prepared to receive the pin or a transfer conveyor motor which transports the pin 10 from the lift assembly to the pin collecting assembly 6 and the lift motor must be turned off until the next pin is ready to be transferred. An assembly elevation motor causes the combined spot and re-spotting assembly to be raised or lowered in direction 62 while a middle member actuator is configured to cause a relative motion in direction 84 between the middle member and the bottom member and a top member actuator is configured to cause a relative motion between the top member and the middle and bottom members in direction 82.

Figure 3:
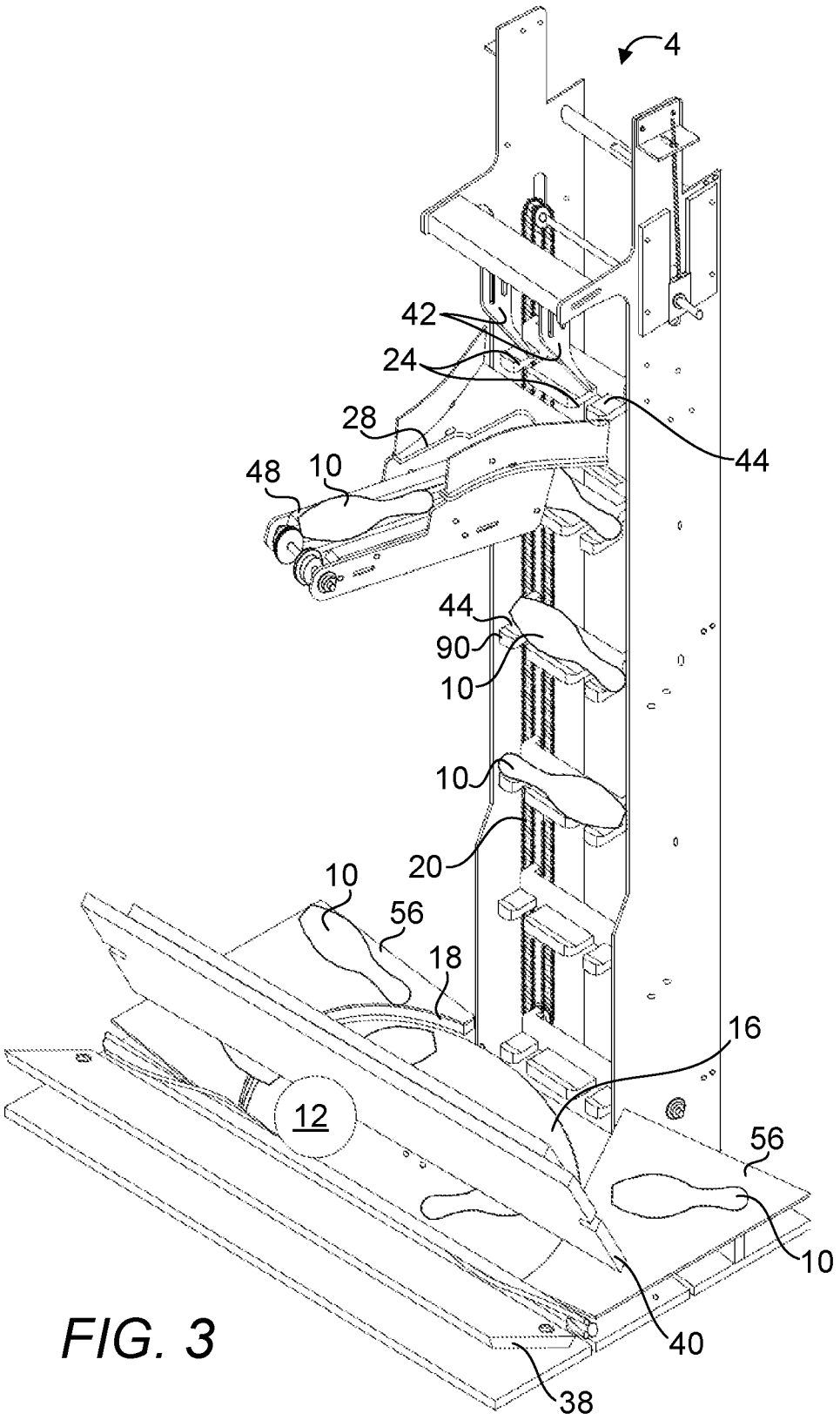
FIG. 3 is a top perspective view of a pin lift assembly useful for transporting fallen pins to a pin collecting assembly.
Figure 3A:
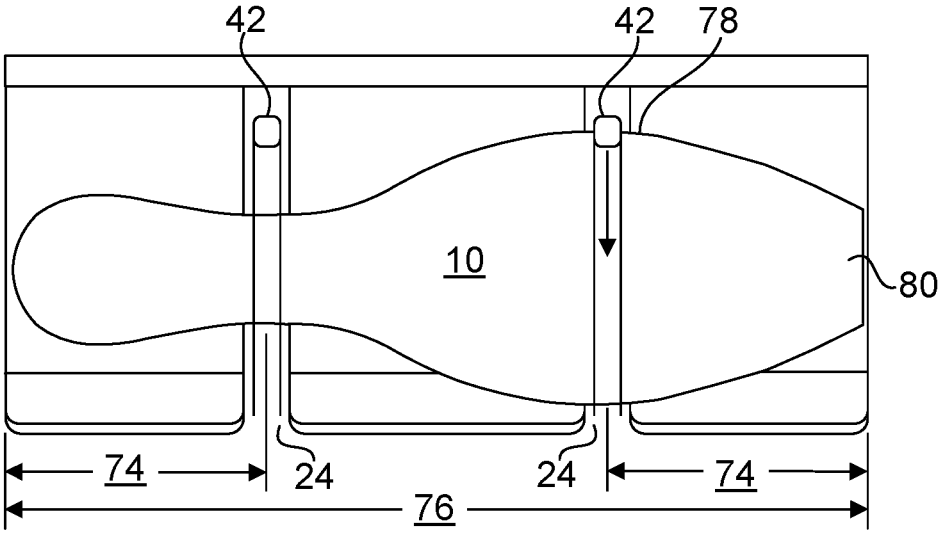
FIG. 3A is a partial top transparent view of a shelf of a pin lift assembly.

FIG. 3 is a top perspective view of a pin lift assembly useful for transporting fallen pins to a pin collecting assembly. FIG. 3A is a partial top transparent view of a shelf of a pin lift assembly. In the embodiment shown, the pin lift assembly 4 includes a band, e.g., two parallel continuous chains 20. Only one chain is visible in FIG. 3 although a total of two chains are used one to support each widthwise end of a shelf 44. In the embodiment shown, each shelf 44 includes an upwardly disposing lip 90 for further securing a bowling pin supported therein. Each chain is driven by a sprocket located on the top shaft of the pin lift assembly. In one embodiment, the band 20 includes a chain including a plurality of links, each link including two ends, each end of each of the plurality of links configured to be connected to one end of another link of the plurality of links. The bottom sprockets are located on an idler shaft. The top shaft is driven by the pin lift motor (not shown). The lift assembly is vertically-arranged assembly 6 including at least one continuous band that serves as a backbone to move bowling pin from a bottom portion to a top portion such that the bowling pin 10 can be eventually placed on a pin deck 60 for the next round of bowling. The band is configured to revolve between a top portion and a bottom portion of the band in a first direction. In the embodiment shown herein, the band 20 includes a pair of chains configured to rotate in unison, each supporting a widthwise end of a plurality of shelves 44. In another embodiment not shown, a single chain suffices in supporting a plurality of shelves 44. In yet another embodiment not shown, a band 20 is a belt constructed from a flexible or resilient material, e.g., rubber or polymer, etc., either reinforced or unreinforced with a more rigid material, e.g., steel, etc. Each shelf 44 includes a width, two slits 24 and two widthwise edges, the shelf is attached to the band 20 with the width of the shelf disposed substantially at right angle to the first direction, wherein the shelf is configured to receive a bowling pin having a skirt and a belly and move the bowling pin from the bottom portion to the top portion of the band 20. Two fangs 42 are disposed at the top portion of the band 20 within a sweep area of the shelf 44, each of the two fangs 42 is disposed at a first distance 74 with one of the two widthwise edges of the shelf 44. Each of the slits 24 is configured to allow one of the two fangs 42 to start making contact and continue making contact as the band 20 continues to revolve to push a bowling pin 10 away from the band 20 to exit at the top portion of the band 20. In one embodiment, the shelf 44 further includes a depth and a depthwise edge, wherein the two fangs 42 extend at a substantially similar depth from the depthwise edge of the shelf and such that the two fangs 42 first make contact with the bowling pin 10 disposed on the shelf 44 at only one of the two fangs 42 at the belly of the bowling pin 10 causing the bowling pin to leave the shelf 44 in an orientation with the skirt of the bowling pin 10 facing away from the shelf 44. In one embodiment, a ratio of the first distance 74 to the width 76 is about 0.24 such that one of the two fangs 42 contacts the belly 78 of the bowling pin 10 to eject the bowling pin 10 from the shelf 44 in an orientation with the skirt 80 of the bowling pin 10 facing away from the shelf 44. The present vertically-arranged lift assembly may be adapted for use with any bowling pin setter mechanisms, including regulation bowling and miniature bowling.

Figure 4:
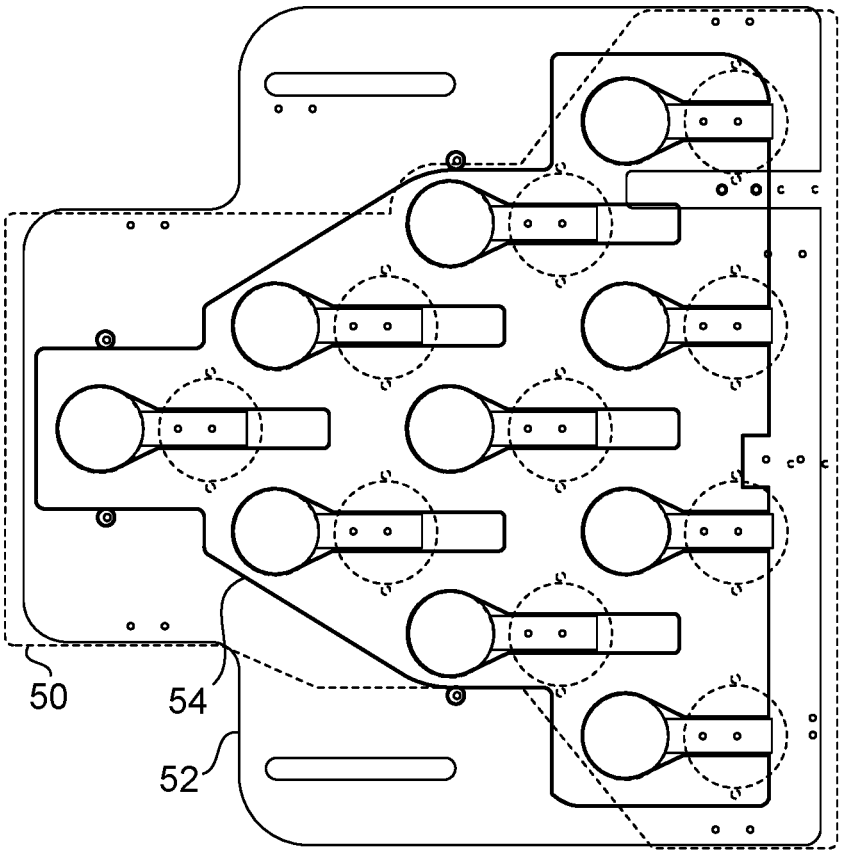
FIG. 4 is a top view of a spot and re-spotting assembly, depicting top, middle and bottom members.
Figure 5:
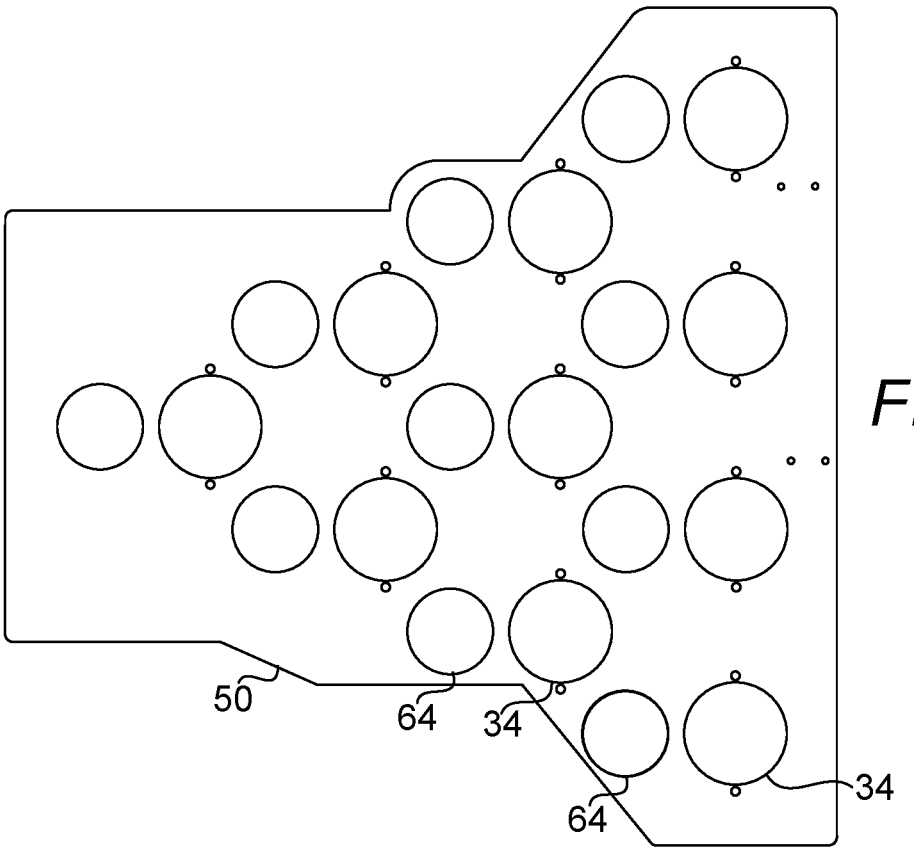
FIG. 5 is a top view of the top member shown in FIG. 4.

FIG. 4 is a top view of a spot and re-spotting assembly, depicting top, middle and bottom members 50, 54, 52. Top member 50 is shown in dashed line while middle member 54 is shown in a thicker lines in order for these members to be distinguished from one another. FIGS. 5-7 depicts these members 50, 54, 52 individually. Top member 50 includes ten sets of chute 34 and opening 64 arranged in a pattern where pins processed therewith are disposed on the pin deck, each set of chute 34 and opening 64 used for servicing a bowling pin. Middle member 54 includes ten sets of opening 68 and channel 66. Bottom member 52 includes ten sets of opening 70 and pin support plate 22 disposed adjacent the opening 70.

Figure 8A:
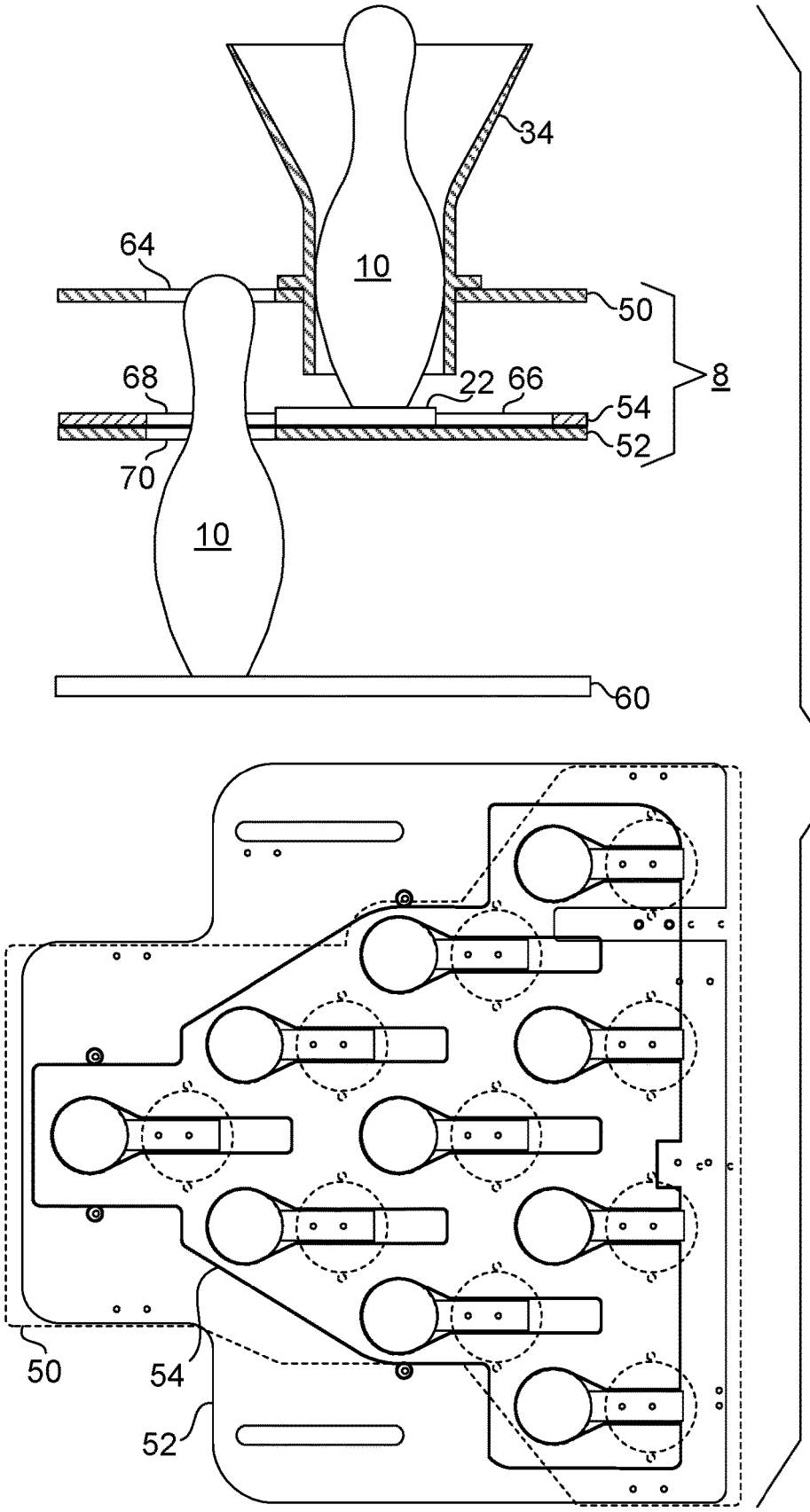
FIGS. 8A-8F is a series of diagrams depicting a process of re-spotting using the assembly shown in FIG. 4.
Figure 8B:
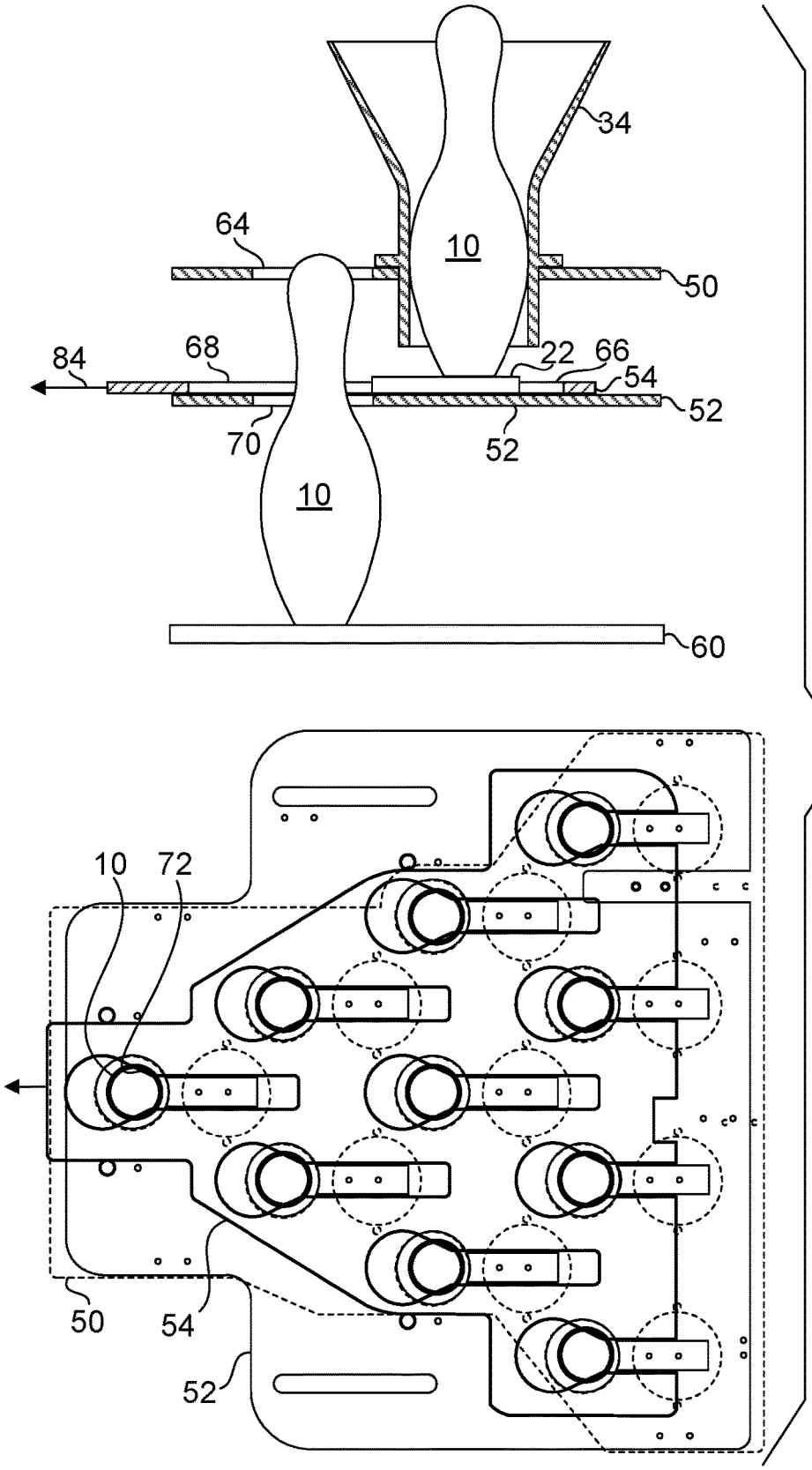
Figure 8C:
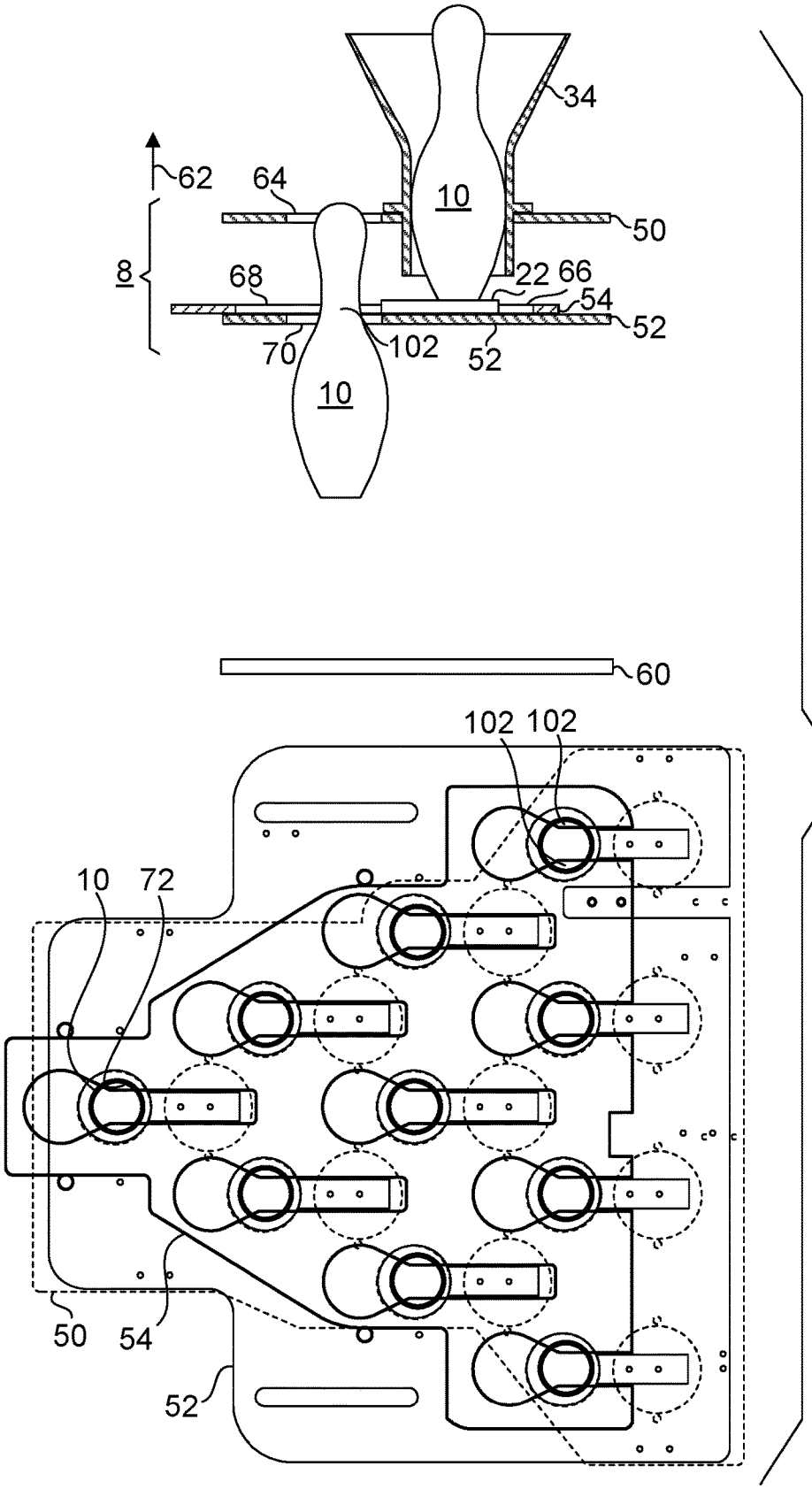
Figure 8D:
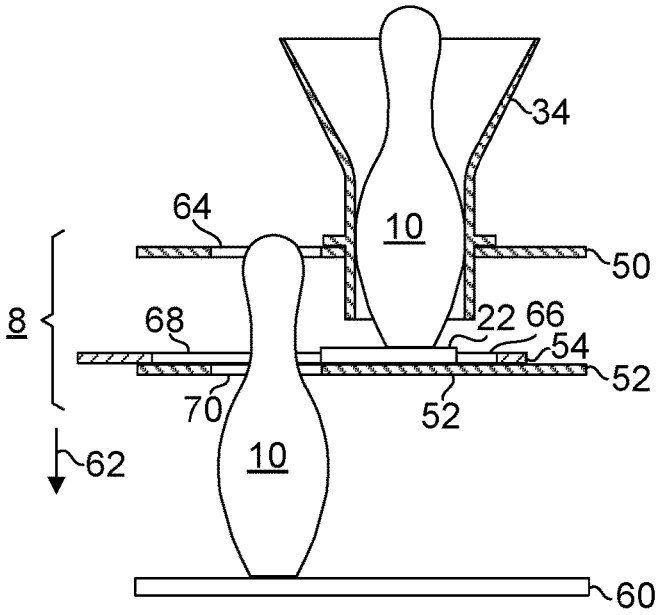
Figure 8D:
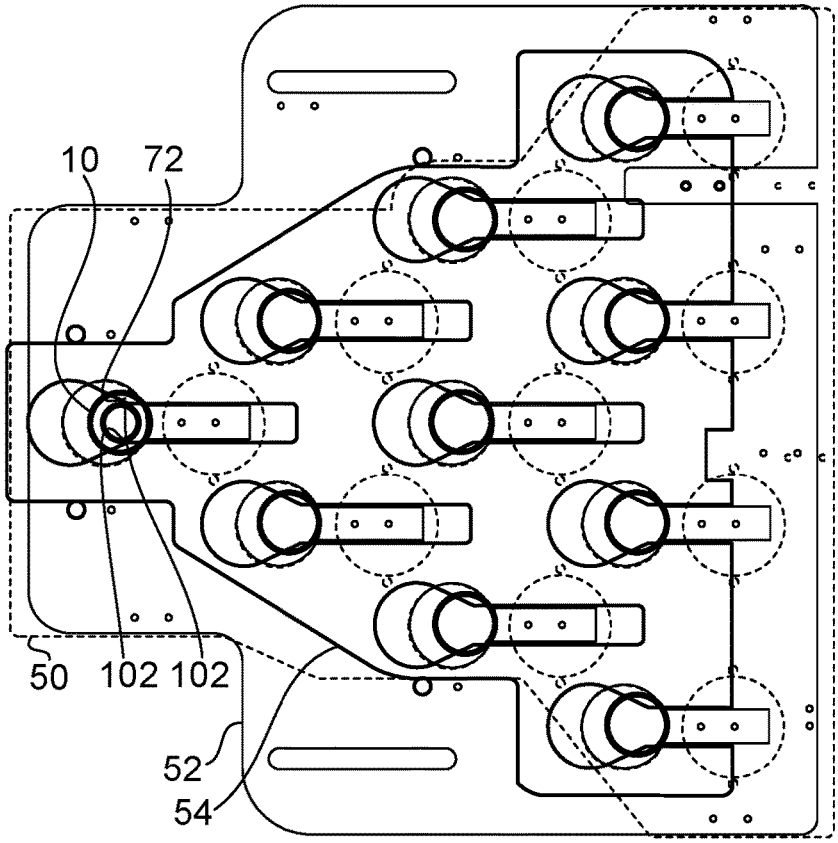
Figure 8E:
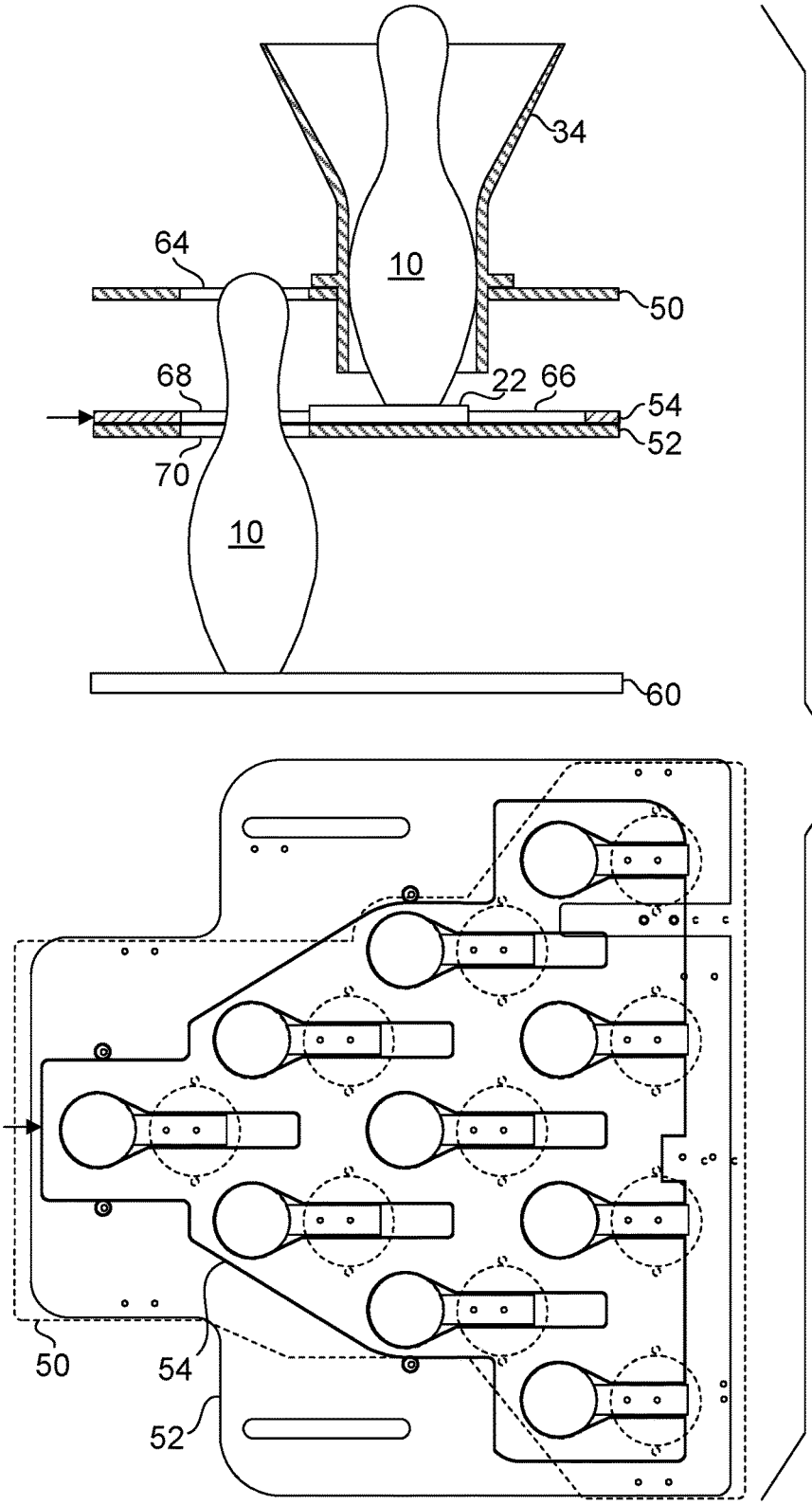
Figure 8F:
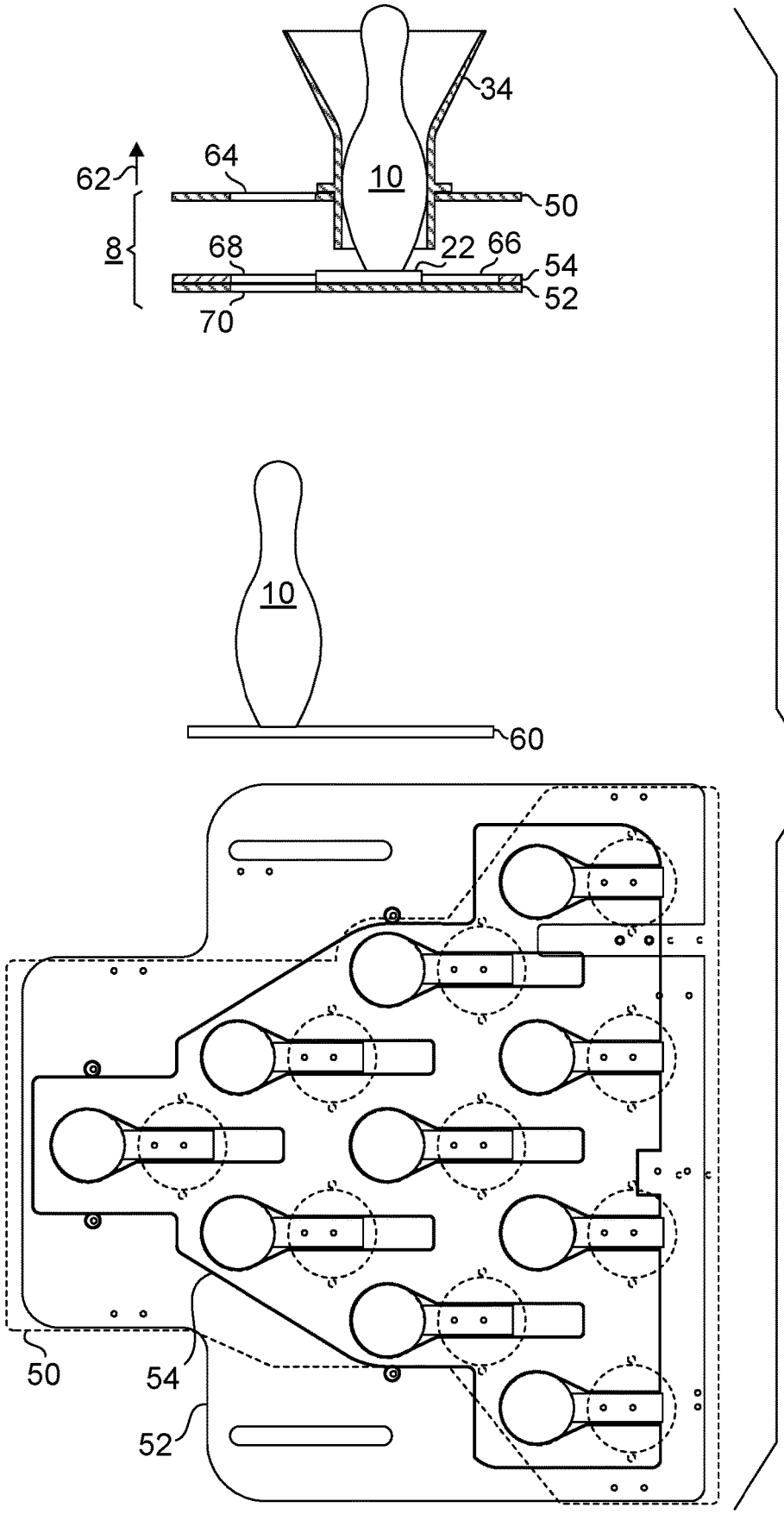

FIGS. 8A-8F is a series of diagrams depicting a process of re-spotting using the assembly shown in FIG. 4. FIGS. 9A-9G is a series of diagrams depicting a process of spotting using the assembly shown in FIG. 4. In each diagram, a side partial cross-sectional view is shown along with a top view of the members involved. No pins are shown with these top views. Referring to FIG. 8A, the assembly 8 is shown to have moved down in its lowest setting in preparation to be disposed in a configuration to pick up the pin 10 in an ensuing step. The openings 64, 68 and 70 are made available such that the members 50, 54 and 52 can clear the pin 10. Referring to FIG. 8B, upon reaching a designated height, the assembly 8 will stop its downward travel and be in a position in which the middle member 54 moves forward to a position to pick up the pin 10. The opening 68 in the middle member 54 through which the head of the pin traveled transitions to a channel 66. This channel 66 is only wide enough to allow for the middle member 54 to move forward when the narrow section of the bowling pin neck is present. The channel 66 is however narrow enough so that the head of the pin 10 cannot pass through it. Referring to FIG. 8C, as assembly 8 is moved back up, the pin 10 is lifted from the pin deck 60 and suspended in the air, thus allowing for the sweep operation (not shown) to take place where fallen pins are swept off the pin deck 60 upon which the pin 10 is disposed. Referring to FIG. 8D, at the completion of the sweep operation, the deck assembly lowers until the pin is placed back on the pin deck 60. Referring to FIG. 8E, upon the assembly 8 reaching a pre-determined height, the pin 10 is again supported on the pin deck 60, the middle member 54 is moved back to its original position, thus releasing the pin 10 and the openings 64, 68 and 70 are now again aligned. Referring to FIG. 8F, assembly 8 then returns to its full upwards position as assembly 8 is driven upwardly. This operation may take place with or without a pin ready for spotting being located in chute 34.

Figure 9A:
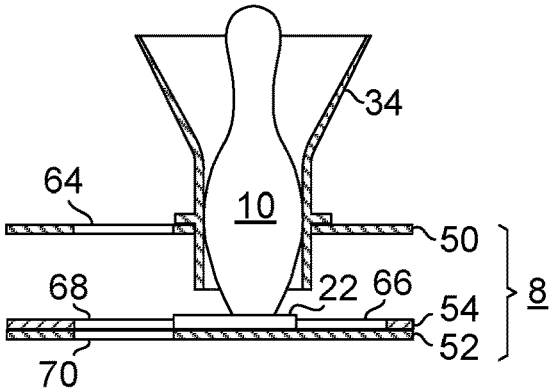
FIGS. 9A-9G is a series of diagrams depicting a process of spotting using the assembly shown in FIG. 4.
Figure 9A:
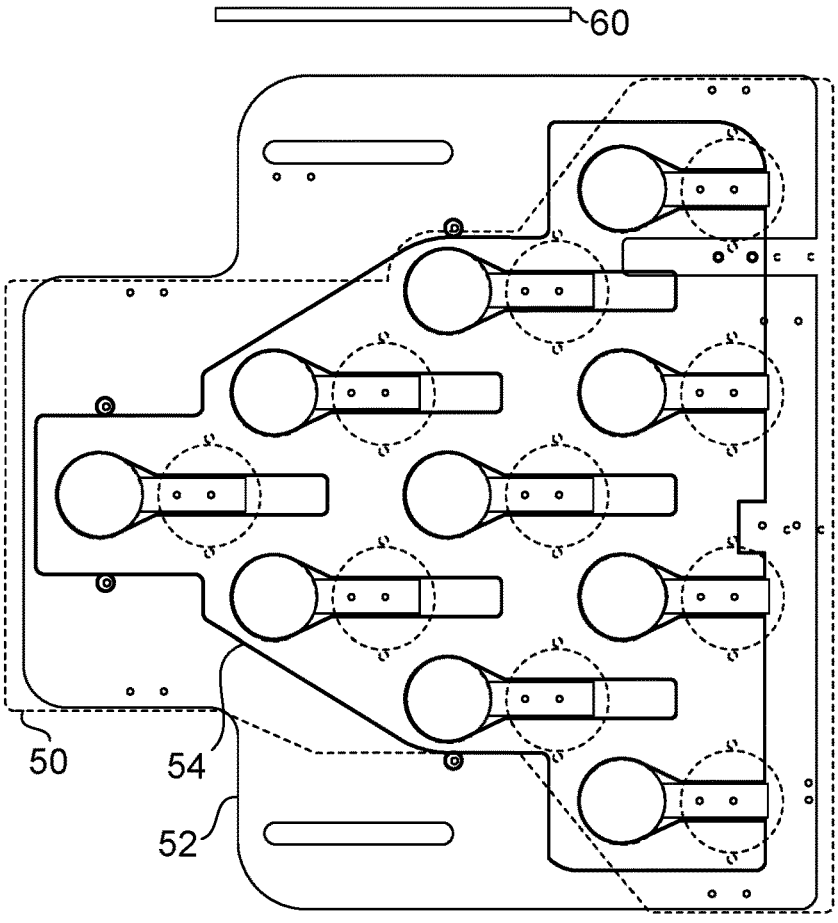
Figure 9B:
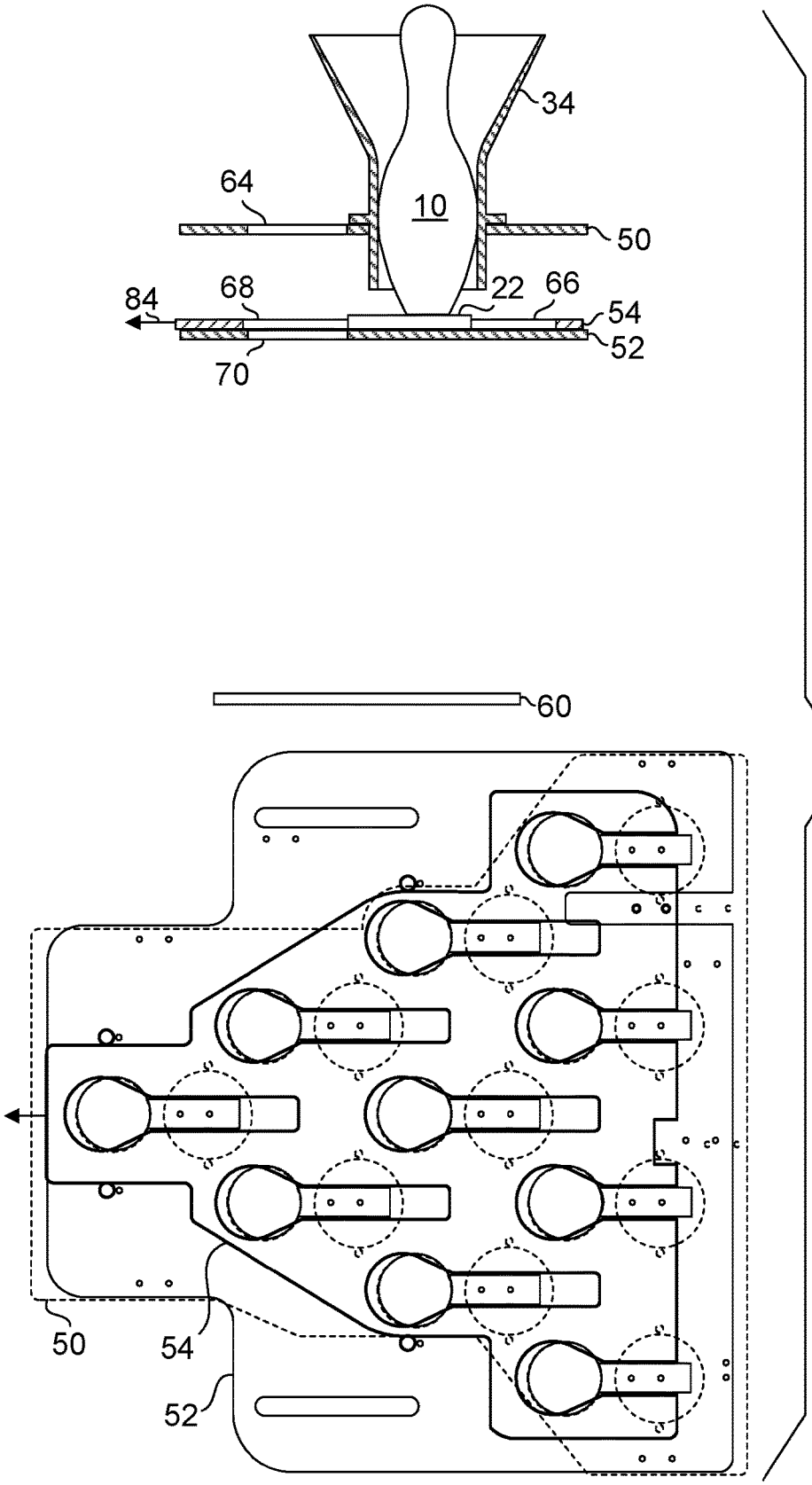
Figure 9C:
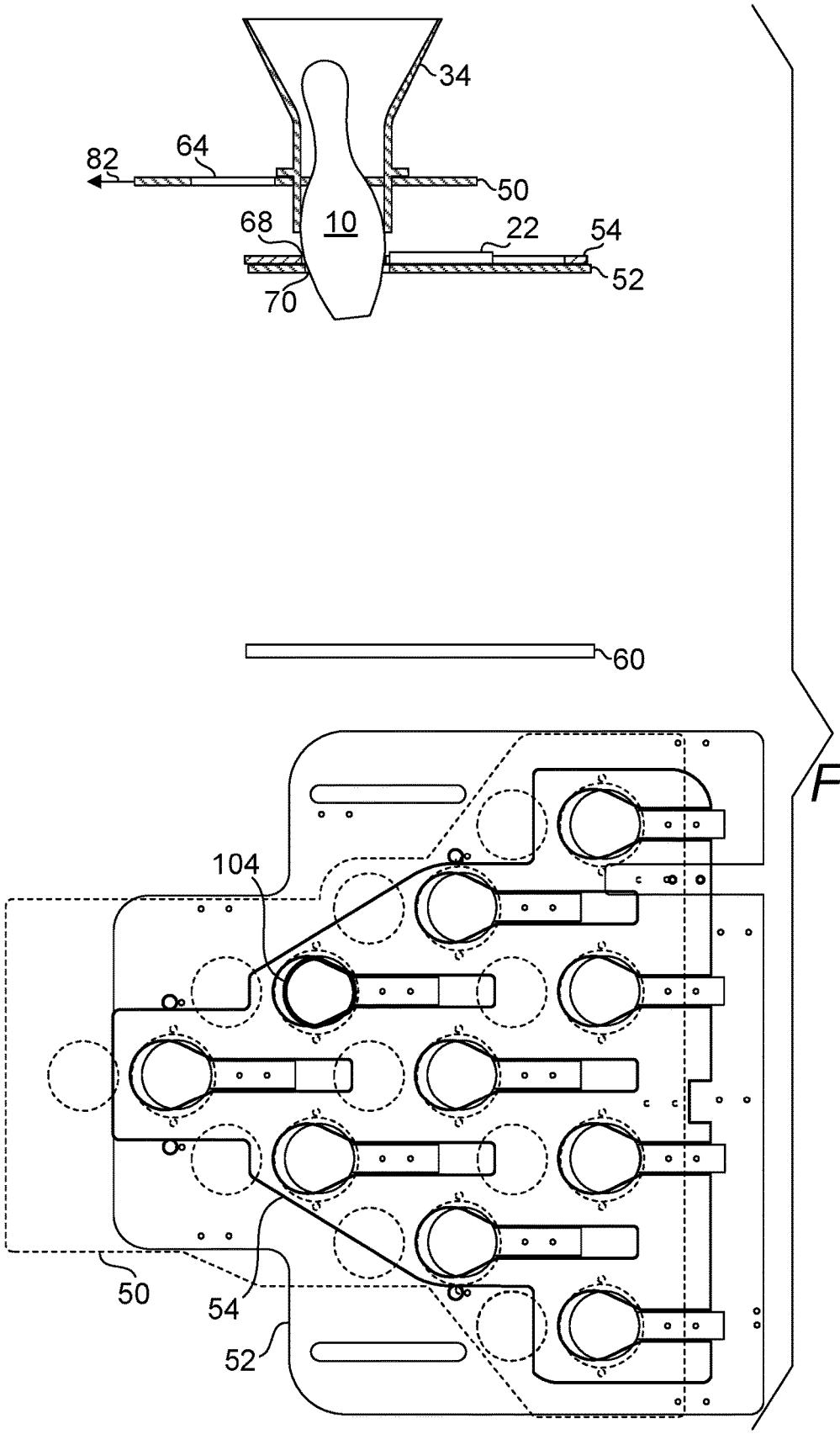
Figure 9D:
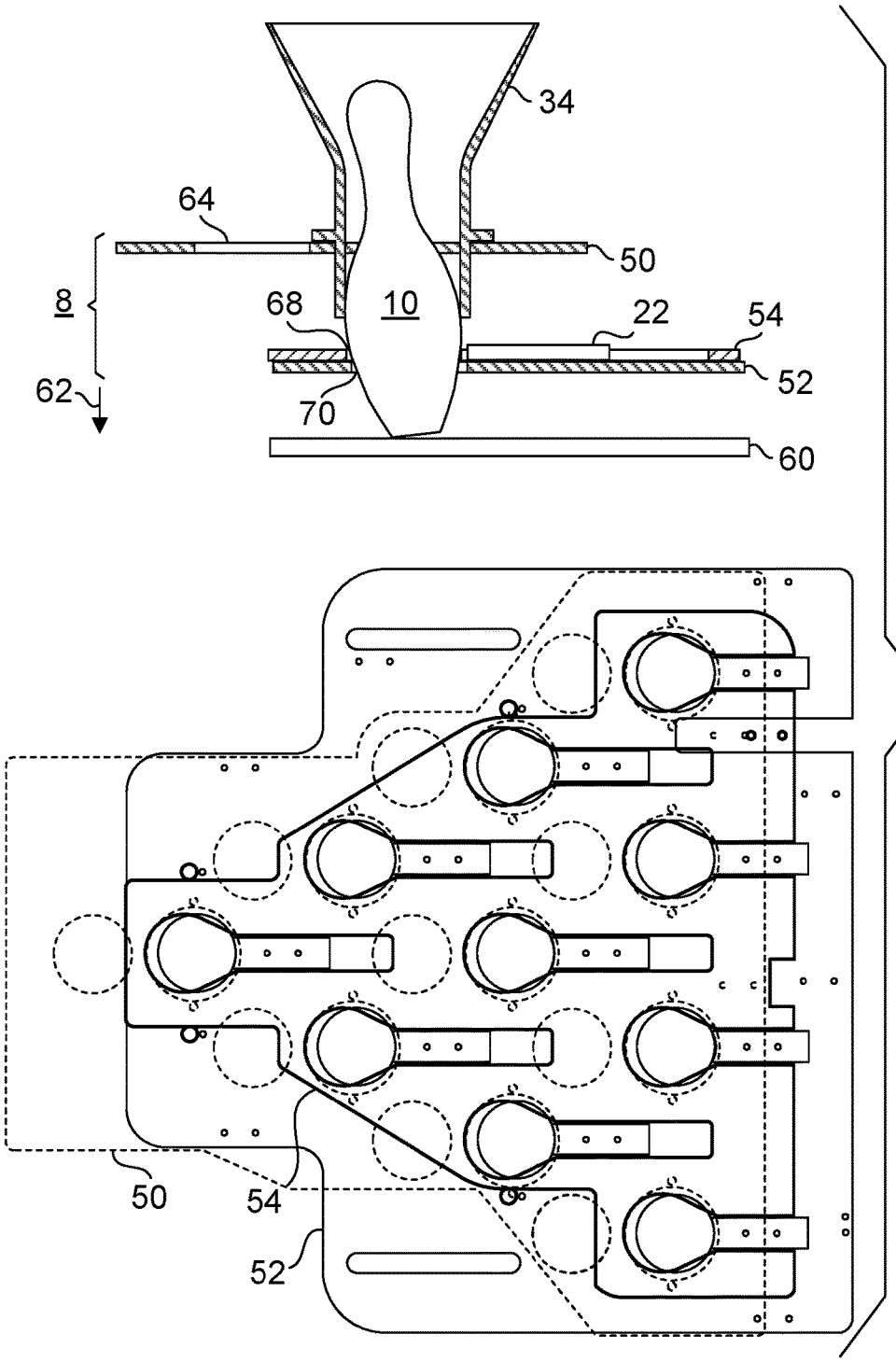
Figure 9E:
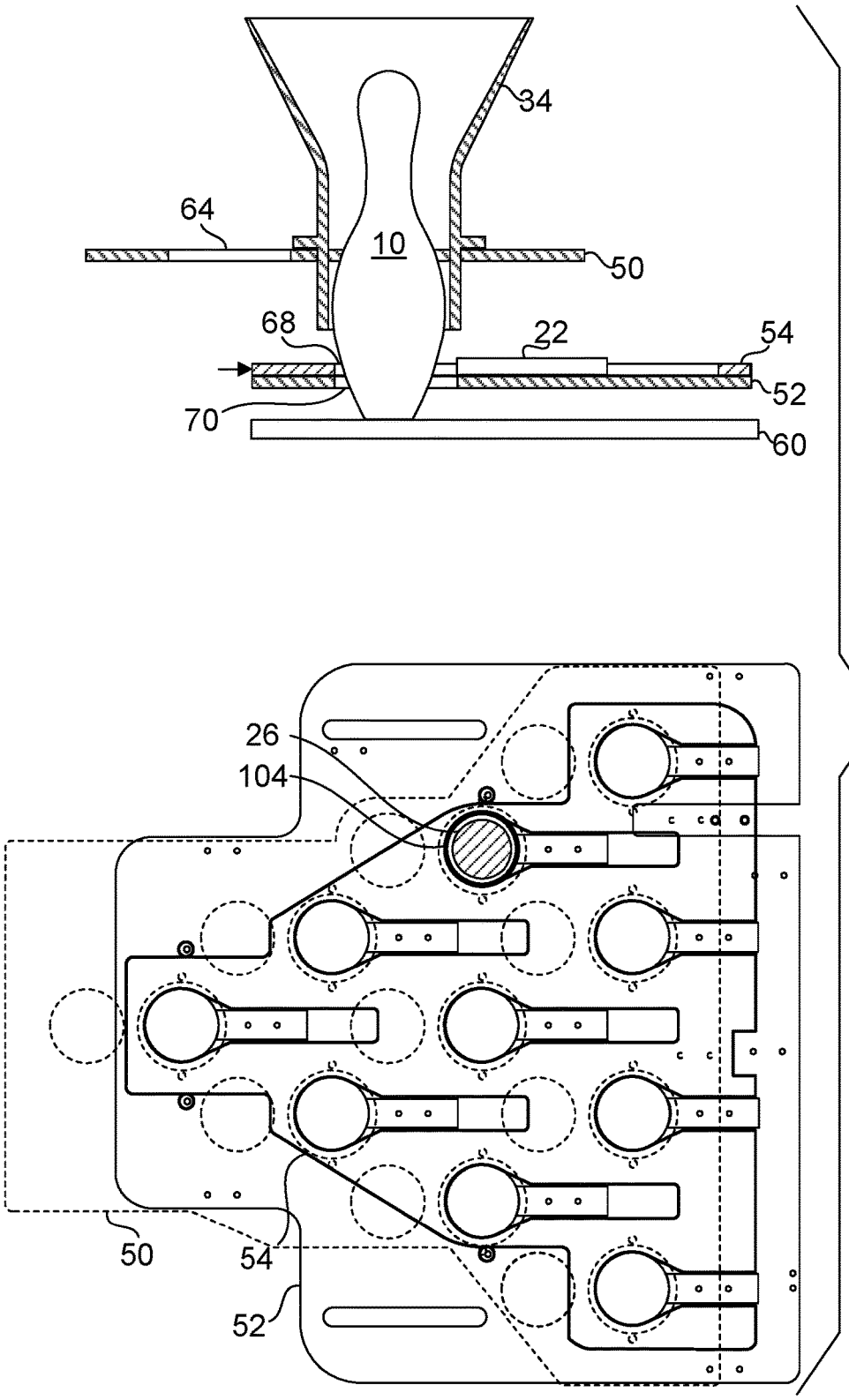
Figure 9F:
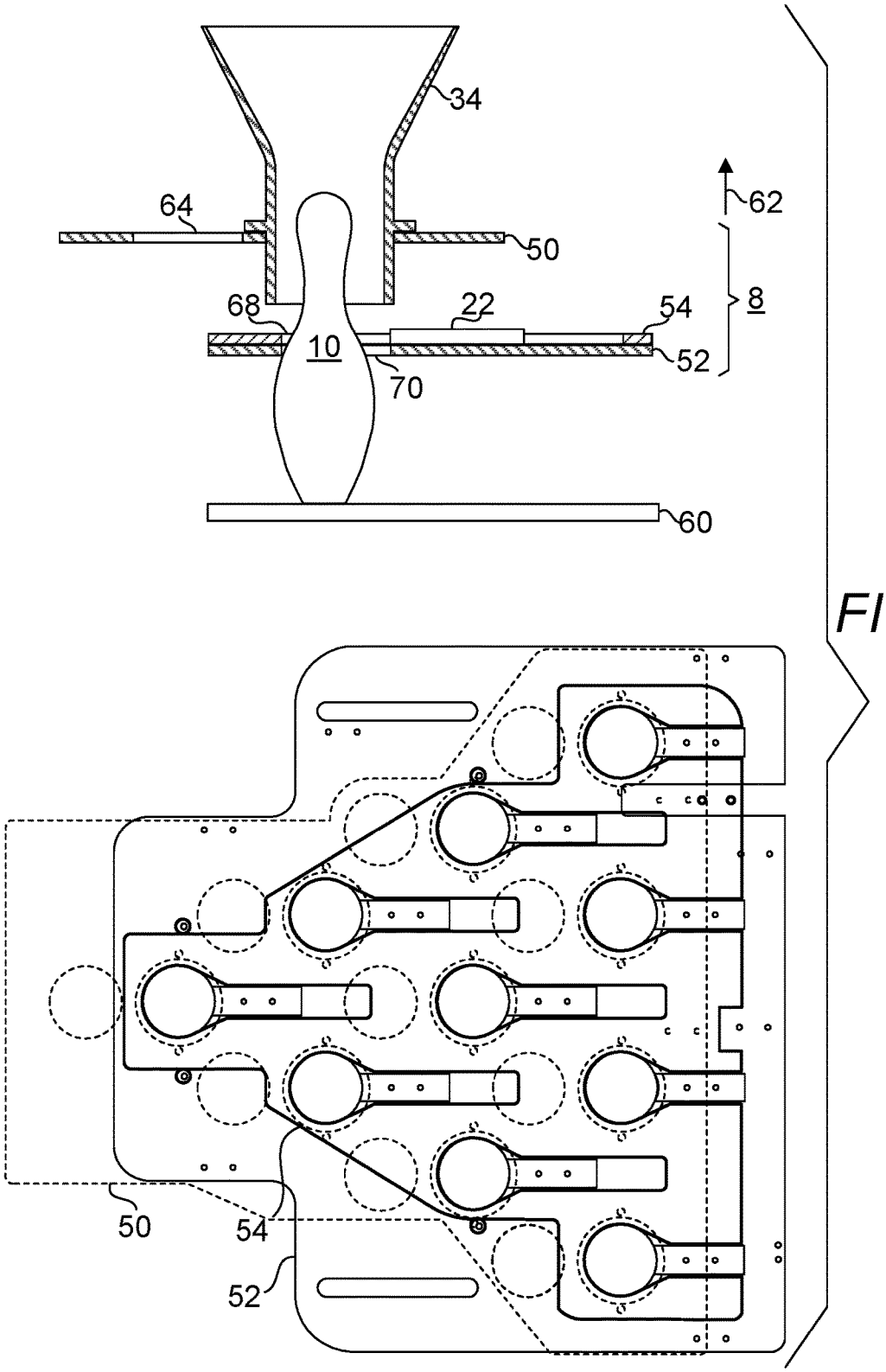
Figure 9G:
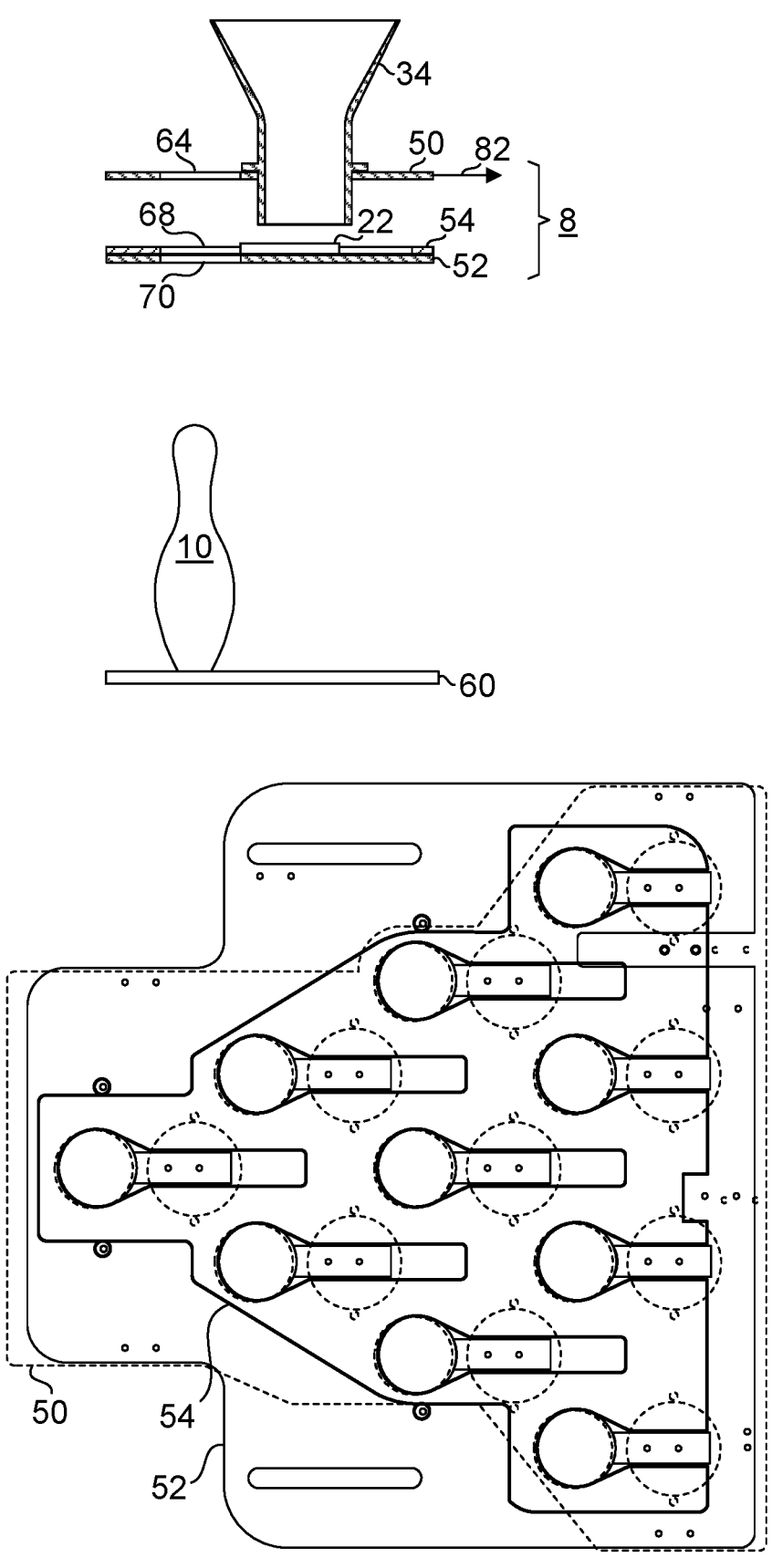

Referring to FIG. 9A, the assembly 8 is shown to have been fully raised position at the start of the spotting cycle. Note that this is the same assembly 8 used for re-spotting the pin 10 shown in FIGS. 8A-8F. Referring to FIG. 9B, the middle member 54 is shown to have moved into the spotting position in direction 84. Referring to FIG. 9C, as assembly 8 begins to move down, the chute deck 50 will move to its fully forward position 82. This motion causes pin 10 to be placed into a position in which it is held in place by middle and bottom members 54, 52 just above its skirt. This position also allows for the skirt of the pin 10 to protrude below assembly 8. Referring to FIG. 9D, assembly 8 continues to be driven down in direction 62 until it reaches its lowest position, thus allowing for the base of the pin to contact the pin deck 60. The middle member 54 is driven to its most rearward position as shown in FIG. 9E before assembly 8 begins to rise as shown in FIG. 9F. As shown in FIG. 9E, assembly 8 continues to be driven down, at which point, the pin 10 is now disposed upright, fully supported by the pin deck 60. The top member 50 is then driven back to its fully rear position as shown in FIG. 9G when assembly 8 achieves its topmost position. Re-spotting is not carried out if the lowering of assembly 8 encounters a force considered too great for the assembly 8 to be lowered to its normal lowest elevation, e.g., in an increased current drawn from the motor driving assembly 8 downwardly. Such condition can occur when a bowling pin has moved from the location where the pin is first spotted after the first throw of the bowling ball. In regulation bowling, a pin setter mechanism must be able to return a moved pin to the location it was moved to after the first throw. Therefore, the present spot and re-spotting is suitable for use with bowling practices, e.g., miniature bowling, which do not need to conform to rules associated with regulation bowling. As a summary, in setting a bowling pin, the present bowling pin setter mechanism can be described as having a top member including a chute, the top member configured to move in a top plane; a bottom member including a bottom opening having an area of a first size and a support plate, the support plate disposed adjacent the bottom opening and the bottom member disposed in a bottom plane; (c) a middle member including a middle opening and a channel extending from the middle opening at a neck area 72, the middle member disposed between the top member and the bottom member, the middle member configured to move in a middle plane parallel to the top plane and the bottom plane; and (d) an actuator configured for lowering and raising an aggregate group of the top, middle and bottom members. Each bowling pin has a maximum longitudinal cross-sectional area 26 around the belly of the pin. The bottom member 52 and the middle member 54 are configured to be slidably coupled such that the channel 66 slides relative to the support plate 22 within the channel 66, the support plate 22 protruding beyond a top surface of the middle member 54 for supporting the bowling pin while the bowling pin is disposed within the chute 34. The top member 50 is adapted to be positioned such that if the chute 34 is aligned with the middle opening 68 biased in position with respect to the bottom opening 70 to form a composite opening 104 (see the bottom diagram of FIG. 9C) of an area of a second size that is smaller than the maximum longitudinal cross-sectional area of the bowling pin (at the belly of the pin). The bowling pin drops into and is retained in the composite opening before the aggregate group 8 is lowered by the actuator such that the bowling pin can be spotted onto a pin deck 60 after the middle member is adjusted such that the composite opening 104 (see the bottom diagram of FIG. 9E) becomes greater than the maximum longitudinal cross-sectional area of the bowling pin and if the composite opening is aligned with the bowling pin, the middle opening is biased with respect to the bottom opening, the bowling pin is raised at the neck area 102 when the aggregate group is raised to allow sweeping to occur at the pin deck. As the aggregate group 8 is lowered onto the pin deck 60, the bowling pin 10 is re-spotted. In the embodiment shown herein, the top member 50 further includes a top opening 64 that accommodates the bowling pin that is being re-spotted so that the top member 50 can be disposed at a minimum distance from the middle member 54 to form the aggregate group 8 that is compact. In one embodiment, the ratio of the second size to the first size is preferably about 0.8.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A combined spot and re-spotting assembly of a bowling pin setter mechanism for re-spotting a first bowling pin and spotting a second bowling pin, each of the first bowling pin and the second bowling pin having a maximum longitudinal cross-sectional area and a neck, said combined spot and re-spotting assembly comprising:

(a) a top member comprising a chute comprising a central axis, said top member configured to slide in a top plane and said chute is disposed in a manner such that said central axis of said chute is substantially perpendicular to said top plane and said chute is disposed within said top member;

(b) a bottom member comprising a bottom opening and a support plate, said bottom opening comprising an area of a first size and a central axis, said support plate extending from a top surface of said bottom member adjacent said bottom opening, said bottom member disposed in a bottom plane, wherein said support plate is disposed in a plane parallel to said bottom plane and said bottom opening is disposed in a manner such that said central axis of said bottom opening is substantially perpendicular to said bottom plane and said bottom opening is disposed within said bottom member;

(c) a middle member comprising a middle opening and a channel extending from said middle opening at an edge of said middle opening, said middle opening comprising a central axis, said middle member disposed between said top member and said bottom member, said middle member configured to slide in a middle plane parallel to said top plane and said bottom plane and said middle opening is disposed in a manner such that said central axis of said middle opening is substantially perpendicular to said middle plane and said middle opening is disposed within said middle member; and (d) an actuator configured for lowering and raising an aggregate group of said top, middle and bottom members, wherein said bottom member and said middle member are configured to be slidably coupled such that said channel slides relative to said support plate disposed within said channel, said support plate protruding beyond a top surface of said middle member for supporting the second bowling pin while the second bowling pin is disposed within said chute, said top member is adapted to be positioned such that if said chute is aligned with said middle opening that is slidingly biased with respect to said bottom opening to form a composite opening due to an overlapped area of said middle opening and said bottom opening, said composite opening having an area of a second size that is smaller than the maximum longitudinal cross-sectional area of the second bowling pin, the second bowling pin drops into and is retained in said composite opening before said aggregate group is lowered by said actuator such that the second bowling pin can be spotted onto a pin deck after said middle member is adjusted such that the composite opening becomes greater than the maximum longitudinal cross-sectional area of the second bowling pin and if said composite opening is aligned with the first bowling pin, said middle opening is slidingly biased with respect to said bottom opening such that at least a portion of said channel is not blocked by said support plate at said edge of said middle opening, the first bowling pin is raised by said channel at the neck of the first bowling pin when said aggregate group is raised to allow sweeping to occur at the pin deck and said aggregate group is lowered onto the pin deck, the first bowling pin is re-spotted.

2. The combined spot and re-spotting assembly of a bowling pin setter mechanism of claim 1, wherein said top member further comprises a top opening that accommodates the first bowling pin that is being re-spotted so that said top member can be disposed at a minimum distance from said middle member to form said aggregate group that is compact.

3. The combined spot and re-spotting assembly of a bowling pin setter mechanism of claim 1, wherein the ratio of said second size to said first size is about 0.8.

* * * * *